US007466951B2

(12) United States Patent
Gilmore

(10) Patent No.: US 7,466,951 B2
(45) Date of Patent: Dec. 16, 2008

(54) HEATER ASSEMBLY IN A FUSER WITH A RAISED RESILIENT PAD IN AN ELECTROPHOTOGRAPHIC IMAGING DEVICE

(75) Inventor: James D. Gilmore, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 75 days.

(21) Appl. No.: 10/954,813

(22) Filed: Sep. 29, 2004

(65) Prior Publication Data

US 2006/0067751 A1 Mar. 30, 2006

(51) Int. Cl.
*G03G 15/20* (2006.01)

(52) U.S. Cl. ..... 399/329

(58) Field of Classification Search ..... 399/329, 399/328

See application file for complete search history.

(56) References Cited

U.S. PATENT DOCUMENTS

| | | | | |
|---|---|---|---|---|
| 5,499,088 | A | 3/1996 | Menjo | 355/285 |
| 5,732,318 | A | 3/1998 | Natsuhara et al. | 399/329 |
| 5,860,051 | A | 1/1999 | Goto et al. | 399/529 |
| 6,075,228 | A | 6/2000 | Goto et al. | 219/216 |
| 6,108,500 | A | 8/2000 | Ohkama et al. | 399/67 |
| 6,384,378 | B2 | 5/2002 | Natsuhara et al. | 219/216 |
| 6,392,197 | B2 | 5/2002 | Natsuhara et al. | 219/216 |
| 6,864,461 | B2 * | 3/2005 | Okabayashi et al. | 219/216 |
| 7,027,763 | B2 * | 4/2006 | Kato et al. | 399/329 |
| 2001/0019676 | A1 | 9/2001 | Okubo et al. | 399/328 |
| 2001/0019677 | A1 | 9/2001 | Ishizaki et al. | 399/329 |
| 2002/0051659 | A1 * | 5/2002 | Baba et al. | 399/307 |
| 2005/0117943 | A1 * | 6/2005 | Nakafuji et al. | 399/328 |

FOREIGN PATENT DOCUMENTS

| | | | |
|---|---|---|---|
| JP | 04350884 | A * | 12/1992 |
| JP | 08211772 | A * | 8/1996 |
| JP | 09197880 | A * | 7/1997 |
| JP | 2004053618 | A * | 2/2004 |
| JP | 2004061718 | A * | 2/2004 |
| JP | 2004061742 | A * | 2/2004 |

* cited by examiner

*Primary Examiner*—Quana M Grainger

(57) ABSTRACT

An electrophotographic imaging device includes a print media transport assembly and a fuser positioned in association with the print media transport assembly. The fuser includes a heater assembly having a housing carrying a heater and a resilient pad. The resilient pad extends from the housing. A flexible belt is positioned around the heater assembly and adjacent to the resilient pad. A backup member is positioned in opposition to the heater assembly.

38 Claims, 3 Drawing Sheets

HEATER ASSEMBLY IN A FUSER WITH A RAISED RESILIENT PAD IN AN ELECTROPHOTOGRAPHIC IMAGING DEVICE

BACKGROUND OF THE INVENTION

1. Field of the Invention

The present invention relates generally to electrophotographic imaging devices and, more particularly, to fusers of electrophotographic imaging devices.

2. Description of the Related Art

In the electrophotographic (EP) imaging process used in printers, copiers and the like, a photosensitive member, such as a photoconductive drum or belt, is uniformly charged over an outer surface. An electrostatic latent image is formed by selectively exposing the uniformly charged surface of the photosensitive member. Toner particles are applied to the electrostatic latent image, and thereafter the toner image is transferred to the media intended to receive the final permanent image. The toner image is fixed to the media by the application of heat and pressure in a fuser. A fuser may include a heated roll and a backup roll forming a fuser nip through which the media passes. A fuser may also include a fuser belt and an opposing backup member, such as a backup roll.

As the regulation of office/home printers becomes focused more on the conservation of energy and the environmental impacts of energy usage, the need for so called "instant-on" fusers becomes critical. Instant on fusers do not require idle modes where the fuser is maintained at an elevated temperature through periodic applications of power. For typical color machines the power usage in idle or standby mode is 150-200 watts. The fuser is the main source of power usage in a printing device, typically around 120-170 watts in an idle mode. Currently the Energy Star/Blue Angel certifications allow for such a mode, but in the future there is discussion of eliminating the idle mode feature and requiring energy usage of less than 45 watts when not printing. This will prevent any current fixing roller fuser from being able to either pass Energy Star/Blue Angel certification or have a quick warm up time. Current color fixing roller fusers have a cold start warm up time in the range of 2 to 4 minutes.

Prevailing instant on fuser technology uses either a ceramic heater or an inductive heating system. For maintaining print quality in color printing, instant on fusers require an expensive, elastomer coated belt. In color applications, elastomer coatings are required to generate compliance in the fusing nip to produce high print quality on images with multiple layers of toner. To minimize thermal constraints, these elastomer coated belts are typically made of a metallic base layer (required for inductive heating), rather than the standard polyimide belts used in mono ceramic heater applications. Metallic, elastomer coated, and often PFA sleeved belt costs may be up to five times more than a standard polyimide based belt with only a PFA/PTFE coating (PFA is a perfluoroalkyl vinyl ether copolymer, and PTFE is polytetrafluoroethylene), What is needed in the art is a fuser which allows for the use of a polyimide base layer belt for color printing, provides improved gloss and transparency quality for high speed printing with a ceramic heater, and provides improved print media release properties with less print artifacts.

SUMMARY OF THE INVENTION

The present invention provides a fuser with a heater assembly having a resilient pad which extends above the heater surface to apply a differential pressure to the print media in the fusing nip.

The invention comprises, in one form thereof, an electrophotographic imaging device including a print media transport assembly and a fuser positioned in association with the print media transport assembly. The fuser includes a heater assembly having a housing carrying a heater and a resilient pad. The resilient pad extends from the housing. A flexible belt is positioned around the heater assembly and adjacent to the resilient pad. A backup member is positioned in opposition to the heater assembly.

The invention comprises, in another form thereof, a method of operating a fuser of an electrophotographic imaging device, including the steps of: transporting a print medium to the fuser; carrying the print medium through a fuser nip between a flexible belt and a backup member; heating toner particles on the print medium using a heater assembly positioned on a side of the flexible belt opposite the print medium, the heater assembly having a housing carrying a heater and a resilient pad, the resilient pad extending from the housing; and exerting a nip pressure on the print medium in the fuser nip using the resilient pad which is different than a nip pressure on the print medium in the fuser nip adjacent the heater.

An advantage of the present invention is that a higher differential pressure is exerted on the print media in the fusing nip using the resilient pad.

Another advantage is that the resilient pad allows for the use of a polyimide base layer belt for color printing.

Yet another advantage is that use of the resilient pad provides improved gloss and transparency quality for high speed printing with a ceramic heater.

A still further advantage is that the resilient pad provides improved print media release properties with less print artifacts.

A still further advantage is that the resilient pad allows the use of a polyimide belt with no elastomer coating; thus, creating an instant on ceramic color fuser that still performs as well as much more expensive fusing systems with elastomer coated belts.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
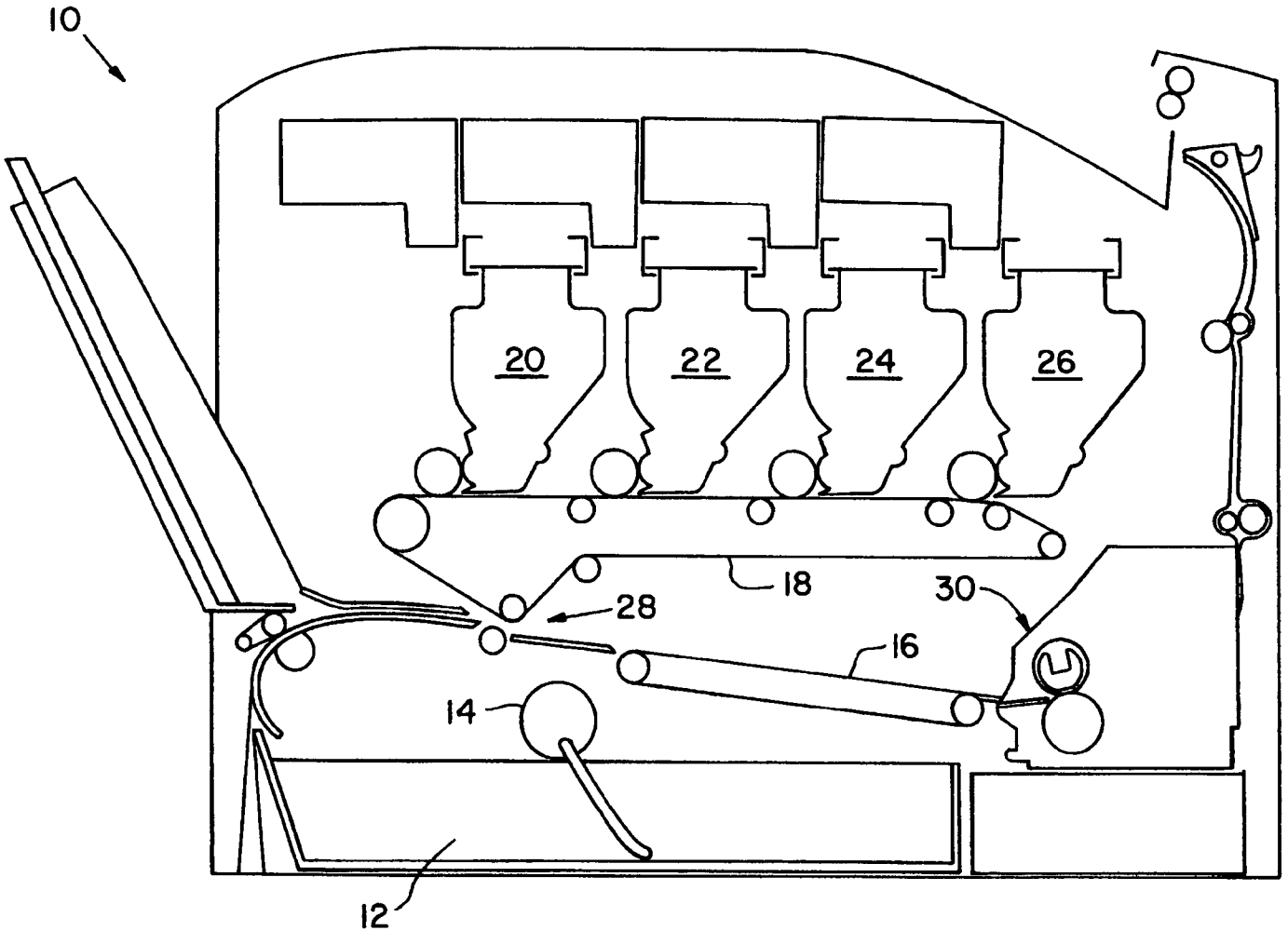
FIG. 1 is a schematic view of an imaging device, in the form of a printer, incorporating a fuser of the present invention.

Referring now to the drawings and particularly to FIG. 1, there is shown an embodiment of an EP printer 10 of the present invention. Paper supply tray 12 contains a plurality of print media (not shown), such as paper, transparencies or the like. A print medium transport assembly (not numbered) includes a plurality of rolls and/or transport belts for transporting individual print media through EP printer 10. For example, in the embodiment shown, the print medium transport assembly includes a pick roll 14 and a paper transport belt 16. Pick roll 14 picks an individual print medium from within paper supply tray 12, and the print medium is transported past an intermediate transfer member (ITM) in the form of an ITM belt 18. A plurality of color imaging stations 20, 22, 24 and 26 apply toner particles of a given color to ITM belt 18 at selected pixel locations. The toner particles are then transferred from ITM belt 18 to the print medium in nip 28. In the embodiment shown, color imaging station 20 is a black (K) color imaging station; color imaging station 22 is a magenta (M) color imaging station; color imaging station 24 is a cyan (C) color imaging station; and color imaging station 26 is a yellow (Y) color imaging station.

Figure 2:
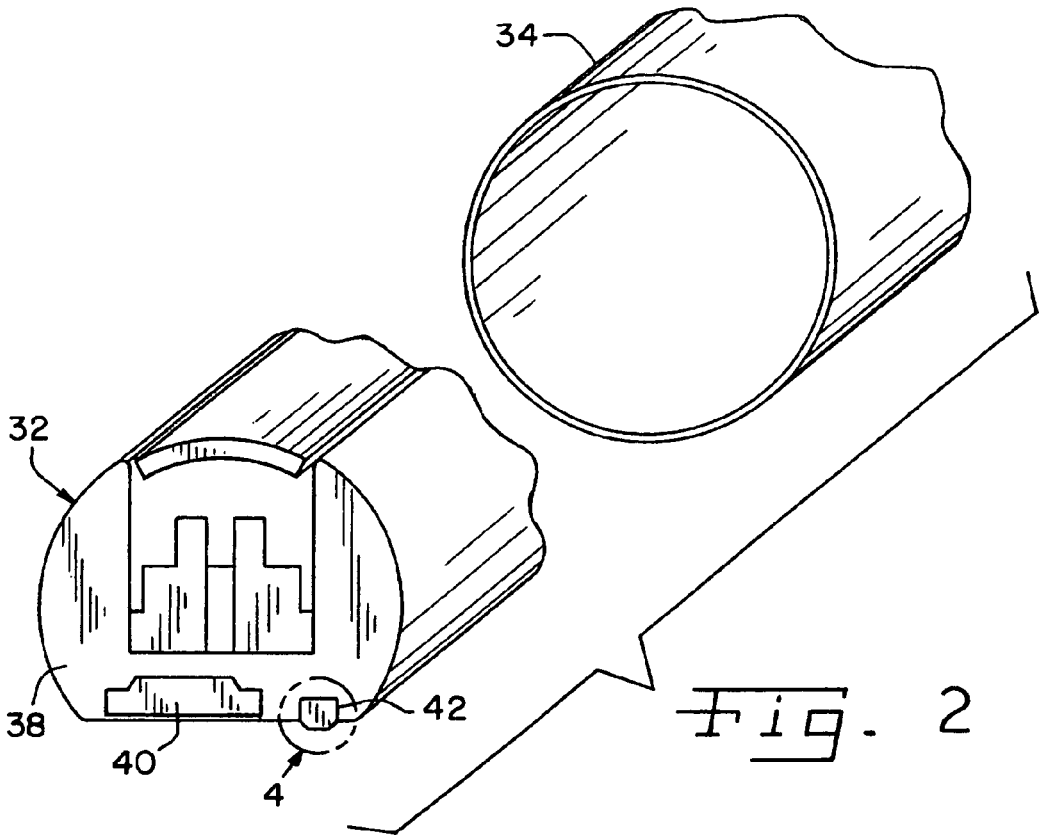
FIG. 2 is an exploded, perspective view of an embodiment of a portion of a fuser of the present invention.
Figure 3:
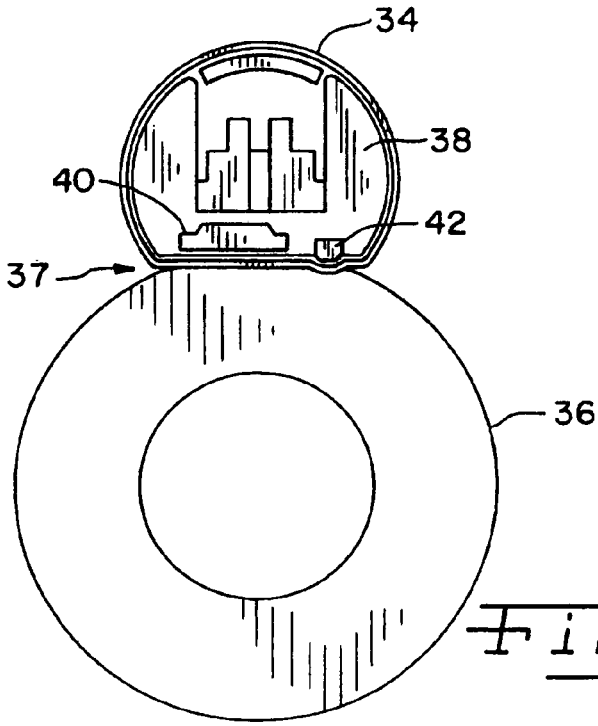
FIG. 3 is an assembled, end view of the portion of the fuser shown in FIG. 2.

Paper transport belt 16 transports an individual print medium to fuser 30 (FIGS. 1-3) where the toner particles are fused to the print medium through the application of heat and pressure. Fuser 30 includes a heater assembly 32, flexible belt 34 carried by heater assembly 32, and backup member in the form of a backup roll 36. In the embodiment shown, backup roll 36 is a driven roll and flexible belt 34 is an idler belt; however, the drive scheme may be reversed depending upon the application. Belt 34 and backup roll 36 define a fuser nip 37 therebetween.

Backup roll 36 has a metallic core and an elastomeric covering, but may be differently configured. Techniques for the general concept of rotatably driving backup roll 36 using gears, belts, pulleys and the like (not shown) are conventional and not described in detail herein.

Heater assembly 32 includes a high temperature housing 38 (liquid crystal polymer or the like) carrying a ceramic heater 40. Ceramic heater 40 includes a ceramic substrate (alumina, aluminum nitride, etc.), a resistive ink pattern screened onto the substrate, and a glass protective layer. Other types of ceramic heaters may also be used. Housing 38 includes a small slot cut in a longitudinal direction at the nip exit side of the housing. A resilient pad 42 of a defined thickness and hardness is placed within this longitudinal slot.

Figure 4:
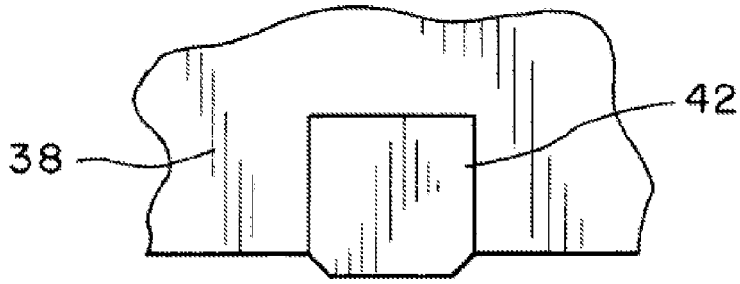
FIG. 4 is an end view of the resilient pad shown in FIGS. 2 and 3, taken at detail 4 shown in FIG. 2.

The shape of resilient pad 42, preferably formed from an elastomeric material, has been shown to affect release characteristics. Rather than a standard rectangle cross-section, it has been found that a trapezoidal shape is preferred (FIG. 4). This shape shows an improvement in release and reduction in curl when compared to a similar rectangle shaped pad.

The height differential between elastomeric pad. 42 and the heater surface (unloaded), should be in the range of 0.5 to 3 mm. A height differential in the range of between 0.5 to 3 mm has been found to be effective, with a smaller height differential resulting in no effect being seen, and a greater height differential resulting in the paper being bent at an angle such that + W curl is imparted to the print media.

The needed height difference may change depending on the location of the pad within the fusing nip and size of the backup roll. Moving the pad towards the entry side reduces the needed height, whereas moving it towards the exit requires a more extreme height difference. The radius of the backup roll is a consideration in that a smaller roll has a tighter radius and thus a larger height pad may be needed to generate enough contact between the backup roll and pad to create the needed pressure differential.

The hardness of the elastomer used in resilient pad 42 is proportional to transmittance and curl; that is, the harder the elastomer the greater gains seen in transmittance and the worse the paper curl imparted. In one embodiment, resilient pad 42 has a hardness ranging from 10 to 50 Shore A. Testing has shown that a hardness over 50 Shore A results in unacceptable levels of curl and a hardness under 10 Shore A results in no significant improvement in gloss or transmittance.

Flexible belt 34 is an idler belt, not a driven belt, and thus friction between belt 34 and resilient pad 42 should be minimized. This may be done by either covering resilient pad 42 with a low-friction material like a silicon oil impregnated teflon film or by simply coating resilient pad 42 in the grease normally used in a ceramic heater system.

Resilient pad 42 creates a raised, differential pressure region (may be higher or lower than heater nip depending on elastomer type) at the exit of fuser nip 37 that creates an optimum exit condition for color printing. Typically with polyimide belt systems, there is some amount of mottling when toned images release off the belt. This mottling is an undesirable print defect for color printers, especially if high gloss is desired. As the page enters the fusing nip, the toner changes to it's molten state and is pressed into the paper fibers by the pressure of the ceramic heater loaded against the backup roller. The nip of a typical ceramic system is a flat nip with an even pressure distribution throughout. As the page exits the nip the speed of the top surface of the page and the belt are nominally the same. This creates a release issue, where release of the toner from the belt is not clean, resulting in a phenomenon termed "taffy pull". For current ceramic systems the lack of compliance as in the roller system and flat nip result in the toner surface being uneven with various high and low spots. This lack of surface uniformity manifests itself in visible gloss differential and unacceptably high surface roughness.

Figure 5:
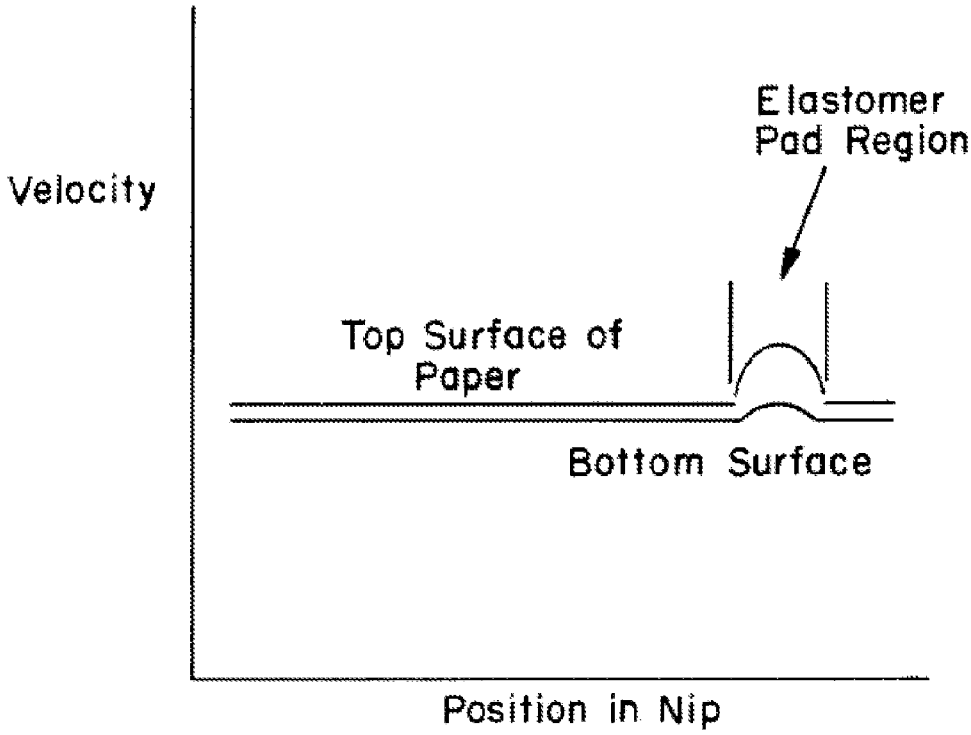
FIG. 5 is a graphical illustration of the print media velocity as the media is advanced past the resilient pad.

By adding resilient pad 42, media release properties are improved through the creation of a pressure zone at the exit side of fuser nip 37. This pressure zone results in a more roller like nip exit leading to clean release and reduced mottling. The pressure difference manifests itself in a peripheral velocity change in the top surface of the media passing through fuser nip 37 (FIG. 5). As the media travels past resilient pad 42, the top surface of the media must travel a longer distance than the bottom surface of the media. Hence, the velocity of the top surface of the sheet is greater than the bottom surface, resulting in a clean release of the toned surface from flexible belt 34. In contrast, a standard flat nip ceramic system has no velocity differential between the top and bottom surface of the media. It is important to optimize the pressure between too high a pressure that generates belt stalls and creating enough of a pressure differential to benefit from the advantages of this fuser system.

Resilient pad 42 also results in improved transparency quality in a standard polyimide belt system. Transmittance is a metric to measure transparency quality: it is a ratio of the amount of light able to pass through a transparency measured at two different locations between an emitter and receiver. If the top surface is uneven (as in the case of a standard polyimide belt system), light does not pass through cleanly. Instead the light is scattered, leading to less vibrant colors and thus unacceptable transparencies. A polyimide belt without the inclusion of a resilient pad 42 is able to sufficiently fuse toner onto transparencies. However, the surface roughness is such that light is scattered when projected through. Adding a thin layer of silicone oil fills in the valleys and evens out the surface of the transparency resulting in acceptable transmittance. This is not an acceptable solution, however, as the belt is an idler belt and requires friction between it and the backup roll and media to drive the belt. Placing any type of oil or liquid in the system may result in belt stalls. The use of resilient pad 42 with a polyimide belt adds compliance to the ceramic system at the nip exit. This compliance and the clean release that results from the surface velocity differential previously described results in a smoother layer of fused toner on the surface of the transparency. Thus, light is able to pass through in a manner which results in more vibrant colors and higher transmittance values.

The use of resilient pad 42 in a ceramic system also reduces cost and increases function of a metal belt configuration. Currently ceramic heater fusers with a metal belt use a thick layer of elastomer (330 to 350 μm) and still show some slight mottling defects. By including resilient pad 42 in a ceramic heater fuser, a differential pressure region created at the fuser nip exit results in cleaner release of the print media from the metal belt. Since resilient pad 42 is only a few millimeters wide (3 to 4 mm optimum), rather than a thick coating around the circumference of the metal belt, less elastomer is used. Also, since the elastomer is on the inside surface of the belt, a low thermal conductivity elastomer is preferred. If the elastomer is made of the same high thermal conductivity elastomer as the thick belt coating layer, it would act as a heat sink, creating problems with dynamic temperature droop. Using a low thermal conductivity elastomer also provides a cost benefit as it does not require expensive doping agents. Thus, a cost benefit is realized by not only using less elastomer, but using a lower thermal conductivity elastomer as well.

As compared to a polyimide belt, the pressure increase of a similar sized and hardness pad is less due to the increase in stiffness of the metal belt. Therefore, a larger height or harder elastomer may need to be used. The stiffness of the belt is determined by the thickness of the metal layer and the diameter of the belt. The proper size and hardness of elastomer pad 42 may be determined empirically. Currently, an elastomer pad 42 with a durometer of 30 Shore A and a width of 3 to 4 mm has been shown to provide increase in gloss and transmittance when used with a metal belt with 250 μm of elastomer and an inner diameter of 30 mm.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An electrophotographic imaging device, comprising:
- a print media transport assembly; and
- a fuser positioned in association with said print media transport assembly, said fuser including:
  - a heater assembly having a housing with a flat outer surface and carrying a heater and a resilient pad, said resilient pad extending from the flat outer surface of said housing when said resilient pad is in an unloaded state;
  - a flexible belt positioned around said heater assembly and adjacent to said resilient pad, said flexible belt being an idler belt; and
  - a backup member positioned in opposition to said heater assembly, said backup member being a driven member.

2. The electrophotographic imaging device of claim 1, wherein said resilient pad comprises an elastomeric pad.

3. The electrophotographic imaging device of claim 2, wherein said elastomeric pad has a hardness of between 10 to 50 Shore A.

4. The electrophotographic imaging device of claim 2, wherein said elastomeric pad extends from said outer surface a distance of between 0.5 to 3 mm in an unloaded state.

5. The electrophotographic imaging device of claim 2, wherein said elastomeric pad has a width in an advance direction of the print media of between 1 to 5 mm.

6. The electrophotographic imaging device of claim 5, wherein said elastomeric pad has a width in an advance direction of the print media of between 3 to 4 mm.

7. The electrophotographic imaging device of claim 2, wherein said elastomeric pad has a thermal conductivity which is lower than a thermal conductivity of said flexible belt.

8. The electrophotographic imaging device of claim 1, wherein said resilient pad is located downstream from said heater relative to an advance direction of the print media.

9. The electrophotographic imaging device of claim 8, wherein said resilient pad is located adjacent an exit side of said housing.

10. The electrophotographic imaging device of claim 1, wherein said flexible belt includes a base layer and a resilient outer layer, said base layer being one of a metallic base layer and a polyimide base layer, said resilient outer layer being one of an elastomer, PFA and PTFE.

11. An electrophotographic imaging device comprising:
- a print media transport assembly; and
- a fuser positioned in association with said print media transport assembly, said fuser including:
  - a heater assembly having a housing with a given configuration and carrying a heater and a resilient pad, said resilient pad extending from the given configuration of said housing when said resilient pad is in an unloaded state;
  - a flexible belt positioned around said heater assembly and adjacent to said resilient pad, said flexible belt being an idler belt; and
  - a backup member positioned in opposition to said heater assembly, said backup member being a driven member, said flexible belt having an inner diameter in an unloaded state of approximately 30 mm.

12. The electrophotographic imaging device of claim 1, wherein said resilient pad is at least partially covered with a friction reducing film.

13. The electrophotographic imaging device of claim 12, wherein said friction reducing film comprises one of a silicon impregnated teflon film and grease.

14. The electrophotographic imaging device of claim 1, wherein said backup member comprises a backup roll.

15. The electrophotographic imaging device of claim 14, wherein said backup roll includes a metal core and a compliant outer surface.

16. A fuser for an electrophotographic imaging device, said fuser comprising:
- a heater assembly having a housing with a flat outer surface and carrying a heater and a resilient pad, said resilient pad extending from the flat outer surface of said housing when said resilient pad is in an unloaded state, said resilient pad being located adjacent an exit side of said housing;

a flexible belt positioned around said heater assembly and adjacent to said resilient pad; and a backup member positioned in opposition to said heater assembly.

17. The fuser of claim 16, wherein said resilient pad comprises an elastomeric pad.

18. The fuser of claim 17, wherein said elastomeric pad has a hardness of between 10 to 50 Shore A.

19. The fuser of claim 17, wherein said elastomeric pad extends from said outer surface a distance of between 0.5 to 3 mm in an unloaded state.

20. The fuser of claim 17, wherein said elastomeric pad has a width in a running direction of said flexible belt of between 3 to 4 mm.

21. The fuser of claim 17, wherein said elastomeric pad has a thermal conductivity which is lower than a thermal conductivity of said flexible belt.

22. The fuser of claim 16, wherein said flexible belt includes a base layer and a resilient outer layer, said base layer being one of a metallic base layer and a polyimide base layer, said resilient outer layer being one of an elastomer, PFA and PTFE.

23. A heater assembly for use in a fuser in an electrophotographic imaging device, said heater assembly comprising a housing with a flat outer surface and carrying a heater and a resilient pad, said resilient pad extending from the flat outer surface of said housing.

24. The heater assembly of claim 23, wherein said resilient pad comprises an elastomeric pad.

25. The heater assembly of claim 24, wherein said elastomeric pad has a hardness of between 10 to 50 Shore A.

26. The heater assembly of claim 24, wherein said elastomeric pad extends from said outer surface a distance of between 0.5 to 3 mm.

27. The heater assembly of claim 24, wherein said elastomeric pad has a width of between 3 to 4 mm.

28. The heater assembly of claim 23, wherein said resilient pad is located adjacent an exit side of said housing.

29. A method of operating a fuser of an electrophotographic imaging device, comprising the steps of:

transporting a print medium to said fuser;

carrying the print medium through a fuser nip between a flexible belt and a backup member;

heating toner particles on the print medium using a heater assembly positioned on a side of said flexible belt opposite the print medium, said heater assembly having a housing with an outer surface and carrying a heater and a resilient pad, said resilient pad extending from the outer surface of said housing when said resilient pad is in an unloaded state, said flexible belt traversing a portion of said outer surface and said resilient pad; and exerting a nip pressure on the print medium in said fuser nip using said resilient pad which is higher than a nip pressure on the print medium in said fuser nip adjacent said heater.

30. The method of operating a fuser of claim 29, wherein said toner particles include multiple color toner particles and said flexible belt has a polyimide base layer.

31. The method of operating a fuser of claim 29, including the step of providing improved gloss and transparency quality using said resilient pad.

32. A method of operating a fuser of an electrophotographic imaging device, comprising the steps of:

transporting a print medium to said fuser;

carrying the print medium through a fuser nip between a flexible belt and a backup member;

heating toner particles on the print medium using a heater assembly positioned on a side of said flexible belt opposite the print medium, said heater assembly having a housing with a given configuration and carrying a heater and a resilient pad, said resilient pad extending from the given configuration of said housing when said resilient pad is in an unloaded state; and exerting a nip pressure on the print medium in said fuser nip using said resilient pad which is higher than a nip pressure on the print medium in said fuser nip adjacent said heater, said resilient pad results in a velocity differential on opposite sides of the print medium, said velocity differential in turn resulting in improved separation between the print medium and flexible belt.

33. The method of operating a fuser of claim 29, wherein said resilient pad comprises an elastomeric pad.

34. The method of operating a fuser of claim 33, wherein said elastomeric pad has a hardness of between 10 to 50 Shore A.

35. The method of operating a fuser of claim 33, wherein said heater has an outer surface, and said elastomeric pad extends from said outer surface a distance of between 0.5 to 3 mm in an unloaded state.

36. The method of operating a fuser of claim 33, wherein said elastomeric pad has a width in a running direction of said flexible belt of between 3 to 4 mm.

37. The method of operating a fuser of claim 33, wherein said elastomeric pad has a thermal conductivity which is lower than a thermal conductivity of said flexible belt.

38. The method of operating a fuser of claim 29, wherein said resilient pad is located adjacent an exit side of said housing.

* * * * *